US006726498B2

(12) United States Patent
Pogliani

(10) Patent No.: US 6,726,498 B2
(45) Date of Patent: Apr. 27, 2004

(54) ELECTRICAL CONNECTOR FOR CONNECTING AN ELECTRIC CABLE TO A CONTACT JUNCTION BOX OF AN ELECTRIC APPARATUS

(75) Inventor: Renato Pogliani, Cavaglietto (IT)

(73) Assignee: Shield S.R. L., Cavaglietto (IT)

( * ) Notice: Subject to any disclaimer, the term of this patent is extended or adjusted under 35 U.S.C. 154(b) by 0 days.

(21) Appl. No.: 10/211,530

(22) Filed: Aug. 5, 2002

(65) Prior Publication Data

US 2003/0049964 A1 Mar. 13, 2003

(30) Foreign Application Priority Data

Aug. 6, 2001 (IT) ..... MI2001A1725

(51) Int. Cl.[7] ..... H01R 13/52
(52) U.S. Cl. ..... 439/272; 439/364
(58) Field of Search ..... 439/272, 273, 439/364

(56) References Cited

U.S. PATENT DOCUMENTS 5,586,909 A * 12/1996 Saba ..... 439/273

* cited by examiner

*Primary Examiner*—Javaid H. Nasri
(74) *Attorney, Agent, or Firm*—Young & Thompson

(57) ABSTRACT

The female electrical connector comprises an external casing having a tubular extension for the passage of an electric cable, and a body inside the casing for supporting internal contacts; watertight sealing means in elastomeric material are provided between the front side and a male contact junction block, in correspondence with the tubular extension for the passage of the electric cable, and in correspondence with a central passing-through hole for a screw to secure the connector to the contact junction block. The sealing means at the front side of the connector comprise an annular gasket co-molded with a guide bush for the anchoring screw. The guide bush extends rearwardly from the contact support body through a hole in the rear wall of the casing; the anchoring screw has a shaped shank to cause elastic compression of the rear end of the guide bush, against a shoulder surface of the hole, and the compression of the annular gasket, during the insertion of the screw into the hole, the guide bush and the tightening to the junction block.

8 Claims, 4 Drawing Sheets

ELECTRICAL CONNECTOR FOR CONNECTING AN ELECTRIC CABLE TO A CONTACT JUNCTION BOX OF AN ELECTRIC APPARATUS

BACKGROUND OF THE INVENTION

This invention refers to a female electrical connector normally used to connect electrical equipments, for example solenoid valves, to an electrical energy source.

More in particular, the invention relates to a watertight sealed electrical connector of the type in which the electric wires of a cable are connected to respective contact members of the connector, by screw means.

The aim of the invention is to improve the watertight seal of the connector, in particular in correspondence with a contact junction block and the passing through hole for an anchoring screw, in a rear wall of the connector.

STATE OF THE ART

As known, in connectors of the aforementioned type it is necessary to provide a suitable watertight seal, both frontally, between the contact support body of the connector and a contact junction block secured to an electrical appliance, in correspondence with a tubular extension for passage of the electric cable, and with a hole for the insertion of an anchoring screw.

In the connectors normally in use, the front seal is obtained by fitting onto the casing, a flat gasket, molded separately and subsequently fitted on manually, by an operator during the assembling of the connector.

As regards the watertight seal, in correspondence with the hole for the passage of the screw through the rear wall of the casing, in general use is made of an annular rib having a triangular cross-sectional shape, against which the head of the anchoring screw is tightly pressed at the fastening of the connector to a junction block, exerting a sufficiently high driving torque to compress and partially deform the apex of the rib in order to achieve the required seal degree.

Conversely, the watertight seal in correspondence with the tubular extension of the casing, for the passage of the electric cable, is obtained by means of an annular gasket appropriately pressed by a ring nut which can be screwed into the same tubular extension of the outer casing of the connector.

The watertight sealing means normally used in the presently known connectors, have several limits and drawbacks, in that they do not afford a sufficiently tight seal, and are made in such a way as to require greater manipulation during the assembling and the connection of an electric cable to the same connector.

In particular, the watertight seal in correspondence with the anchoring screw is obtained by a simple plastic deformation of the rib inside the hole for the passage of the screw in the rear wall of the casing; since such casing is usually made of rigid plastic material, such as nylon with fibreglass filler, to ensure a sufficiently tight seal it is necessary to exert an appropriate driving torque on the screw by the operator, below which the watertight seal of the connector would not be guaranteed.

As the screw is tightened, the head of the latter plastically deforms the apex of the rib inside the hole; consequently, whenever the connector must be removed and/or disassembled, by loosening the screw, and subsequently reassembled, due to the plastic deformation that said rib has been subjected to, it is no longer possible to guarantee the required tightness of the seal.

As regards to the front seal between the connector and a contact junction block, use is conventionally made of a particular gasket molded separately, which must be fitted onto the outer casing by an operator during the assembling of the connector.

Consequently, an incorrect positioning of such gasket may also jeopardize the watertight seal, and in general its assembling involves an additional manipulation and time consuming for the operator.

OBJECTS OF THE INVENTION

The general object of this invention is to provide an electrical connector of the aforementioned kind, provided with improved watertight sealing means.

More in particular, one object of this invention is to provide an electrical connector, as defined above, in which the watertight seal in correspondence with the anchoring screw is obtained, at the insertion and tightening of the same anchoring screw, by suitable elastomeric sealing means which not only guarantees a high tightness degree, but also guarantees that the same tightness degree is made possible even after the connector has been removed and/or disassembled one or more times.

A still further object of this invention is to provide a connector as mentioned previously, in which the front seal is achieved by means of a special gasket defining part of the same contact support body inside the connector.

BRIEF DESCRIPTION OF THE INVENTION

More precisely, according to the invention an electrical connector has been provided of the type comprising:

- an outer casing having a rear tubular extension for the passage of an electric cable;
- a contact support body inside the casing, connectable to a contact junction block of an electric apparatus;
- in which the connector is mechanically anchored to the junction block by screw means which can be screwed into a threaded hole of the aforesaid junction block; and in which
- suitable watertight sealing means are provided between opposite front surfaces of the contact support body and the contact junction block, and in correspondence with the anchoring screw, wherein:
  - said sealing means comprise a flat shaped annular gasket in elastomeric material which extends between the front surface of the contact support body, the front edge of the casing and a peripheral surface of the contact junction block; and
  - a tubular sealing element for the anchoring screw co-molded with the annular gasket, said tubular sealing element rearwardly extending from the contact support body, into a passing-through hole in the rear wall of the casing to be tightly urged against a shoulder surface of said hole by the insertion and tightening of the anchoring screw to said contact junction block.

In particular, the front sealing gasket is provided, on both sides, with a step-shaped peripheral edge which is disposing flush to the edge of the lateral walls of the casing, and which is suitably pressed against a facing peripheral surface of the contact junction block to provide a tight seal upon completion of the fastening of the connector to the same junction block.

According to a further aspect of this invention, the tubular sealing element is in the form of a guide bush for guiding the anchoring screw, which extends rearwardly from the contact support body, along a rigid support sleeve; the guide bush ends with a conically flaring or suitably shaped head, which is elastically pressed, by said anchoring screw, against an annular sealing shoulder surface in a passing-through hole of the outer casing of the connector, by means of a dual action of radial expansion and axial compression exerted by a neck portion of the screw during the fastening to the contact junction block.

BRIEF DESCRIPTION OF THE DRAWINGS

These and further features of the electrical connector according to this invention, will be more clearly evident from the following description with reference to the accompanying drawings, in which.

DETAILED DESCRIPTION OF THE INVENTION

Figure 1:
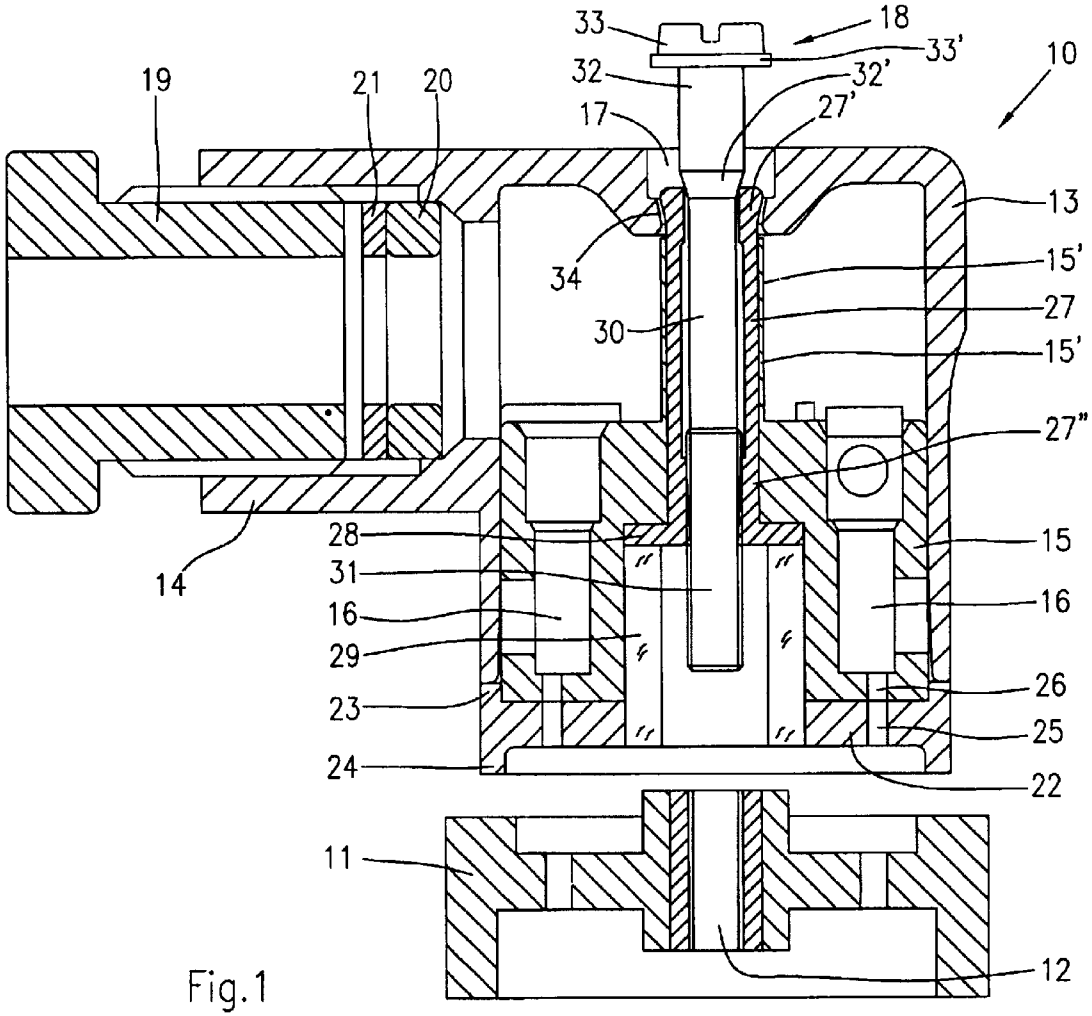
FIG. 1 shows an exploded cross-sectional view of the electrical connector according to the invention and of a contact junction block.

With reference to FIG. 1, a description will first be given of the general features of the electrical connector according to this invention.

As shown in said figure, the electrical connector, indicated as a whole by reference 10, is designed to be fastened to a male contact junction block 11 of an electrical apparatus schematically shown, by means of a central anchoring screw 18 which can be screwed into an axial threaded hole 12 in the junction block 11.

More precisely, the connector 10 comprises an outer casing 13 made of rigid plastic material, for example of nylon charged with a fibreglass filler, such casing 13 being provided with a bush extension 14 for the passage of an electrical cable.

Inside the casing 13 there is provided a contact support body 15, also made of rigid plastic material, having seats 16 for housing respective electrical contact elements (not shown) designed to be connected to the wires of an electrical cable, in a per se known way.

Reference 19 in FIG. 1 indicates a cable-guiding bush, which can be screwed into the tubular extension 14 of the casing 13 of the connector, whereby it is possible to obtain a first watertight seal in correspondence with the same electrical cable, for example, by the axial compression of an annular gasket 20, of elastomeric material, such as rubber or other suitable material, with the disposition of a metal washer 21 between the bush 19 and the annular gasket 20.

As mentioned previously, in an electrical connector of the type shown, in addition to the seal in correspondence with the tubular extension 14 for the passage of the electrical cable, it is also necessary to provide an efficient watertight seal both in correspondence with the front contact surfaces between the connector casing 13, the contact support body 15 and the junction block 11 for connection to an electrical appliance, and in correspondence with the screw 18 for anchoring the connector 10 to the aforesaid junction block 11.

In this connection, according to this invention, a front sealing gasket 22, and a tubular sealing element 27 in the form of a guide bush for the screw 18, both made of elastomeric material, are provided between the connector 10 and the junction block 11, respectively inside the casing 13. More precisely, the tubular element 27 extends rearwardly from the contact support body 15, along and beyond a cylindrical sleeve 15' molded integral with the contact support body 15, axially aligned with a hole or aperture 17 in the rear wall of the casing 13, through which passes the anchoring screw 18.

Both the front gasket 22 and the tubular sealing element 27 for guiding the anchoring screw 18, preferably are co-molded with the contact support body 15, by means of an elastomeric material, for example an elastomeric polyurethane having a hardness ranging from 60–80 Shore A.

More precisely, the front sealing gasket 22 is in the form of an annular gasket having, on both sides, a stepped peripheral edge 23 and 24 protruding at right angles to the surface of the gasket, designed to sealingly contact the edge of the lateral wall of the casing 13, and respectively the peripheral edge of the junction block 11, so as to be compressed and afford an efficient watertight seal by simple axial compression.

The gasket 22 is also provided with several apertures or slits 25 for passage of the male electrical contacts of the junction block 11, aligned with corresponding slits 26 at the front side of the contact support body 15, in correspondence with the housings 16 for the respective female electrical contacts of the connector.

During the co-molding, the front gasket 22 remains joined to the tubular sealing element 27 of the anchoring screw 18, by some lateral strips 29 and a flange 28, inside a central hole in the contact support body 15, from which the anchoring screw 18 protrudes.

According to a further feature of this invention, the watertight seal in correspondence with the hole 17 for passage of the anchoring screw 18 at the rear wall of the casing 13, and towards the screw itself, is obtained by appropriately shaping the same screw 18 and by suitably shaping the rear end 27' of the tubular sealing element 27.

As shown in FIG. 1 and in the remaining figures, the tubular element 27 is provided with a shaped head 27' designed to penetrate, by forcing slightly, into a shouldered portion of the hole 17; in particular, the end 27' is in the form of a conical or flared head designed to be radially and axially pressed against a conical shoulder surface 34 along an inner edge of the hole 17, by the insertion and tightening of the anchoring screw 18.

In this connection, the anchoring screw 18 is obtained by roll shaping with cylindrical shank 30 of reduced diameter, which extends with a fore threaded portion 31 of slightly larger diameter, and a rear neck 32 provided with a head 33; a conical intermediate portion 32' is provided between the neck 32 and the shank 30.

Figure 2:
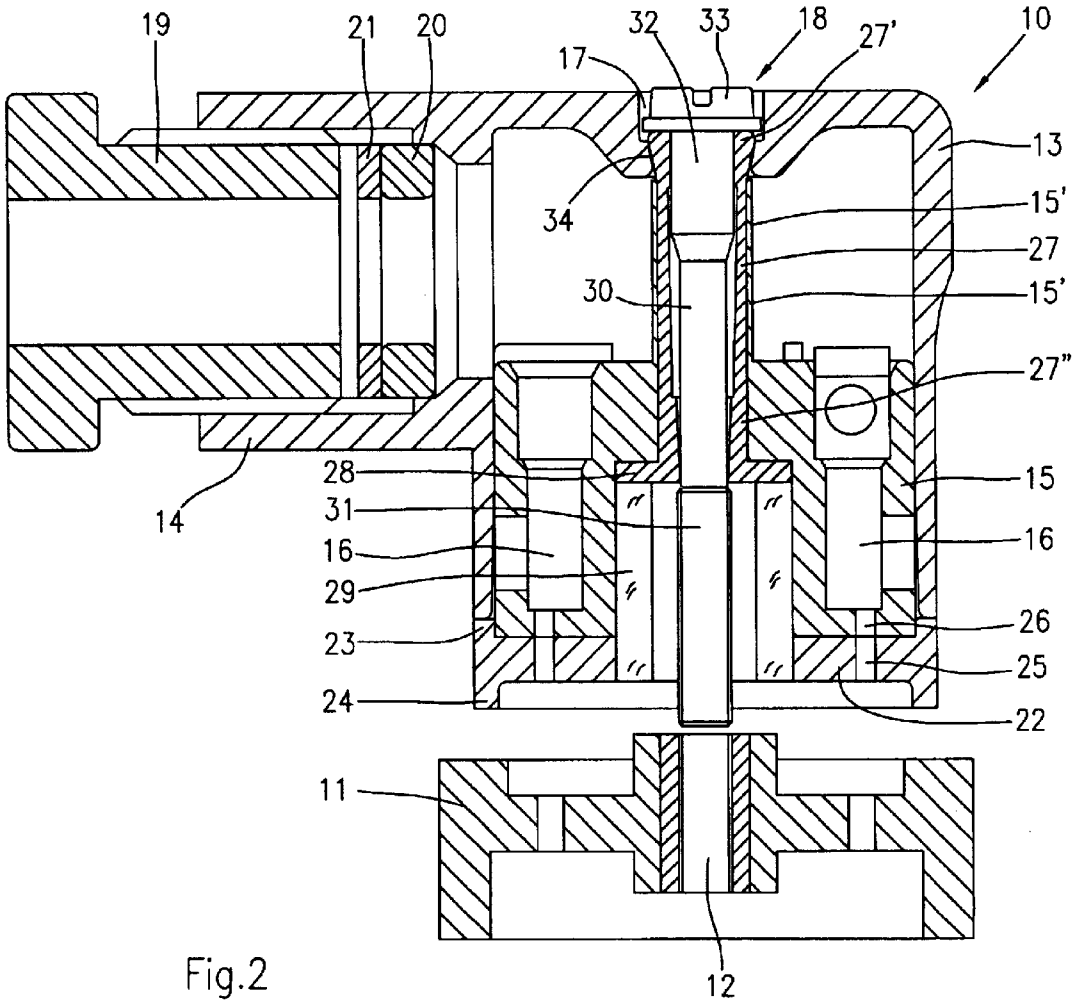
FIG. 2 shows a cross-sectional view similar to that of FIG. 1, to illustrate a first step of radial expansion of the flared end of the tubular sealing element, by the anchoring screw.

The rear neck 32 of the screw 18 has a larger diameter than the internal diameter of the shaped head 27' of the tubular sealing element, for the reasons explained further on; conversely, the fore threaded portion 31 of the same screw 18 has an outer diameter slightly larger than the minimum diameter of the conical hole portion 27" of the same tubular element 27, to prevent the screw 18 from accidentally slipping out after it has been fully inserted into the tubular extension 27 of the body 15 and pushed forward, as shown in the subsequent FIG. 2.

Figure 3:
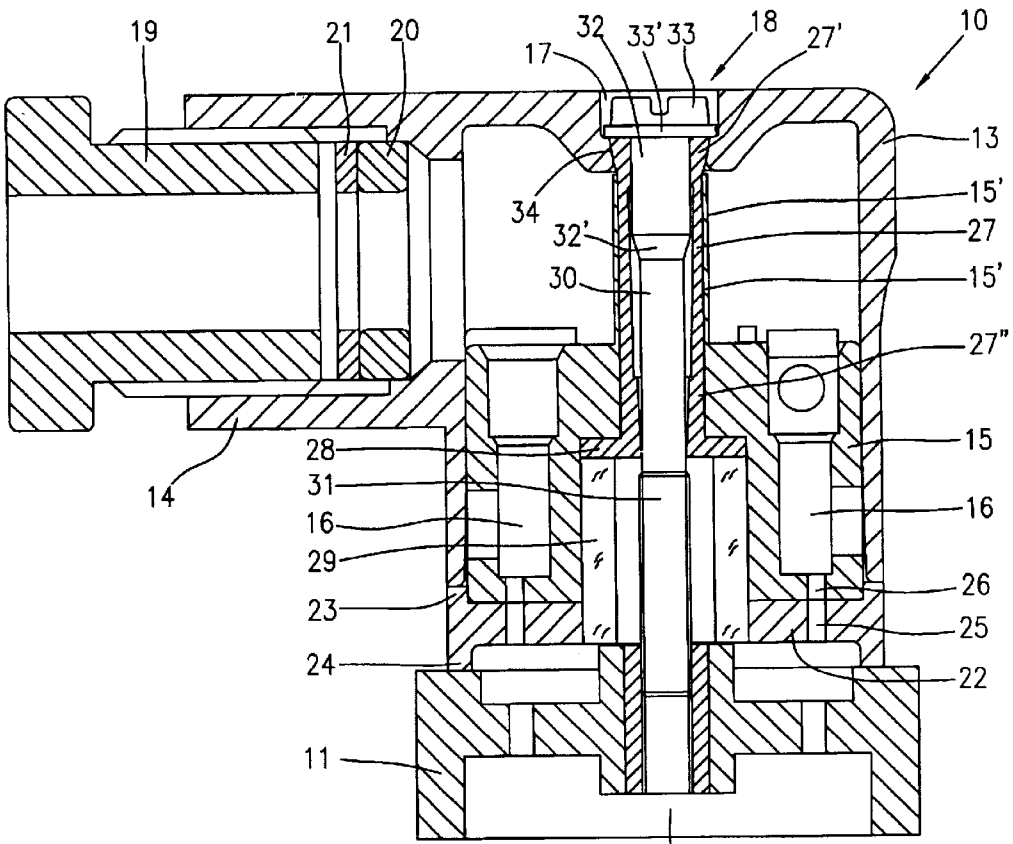
FIG. 3 shows a cross-sectional view similar to that of the previous figures, to illustrate a second axial compression step of the end of the tubular sealing element by the anchoring screw.
Figure 4:
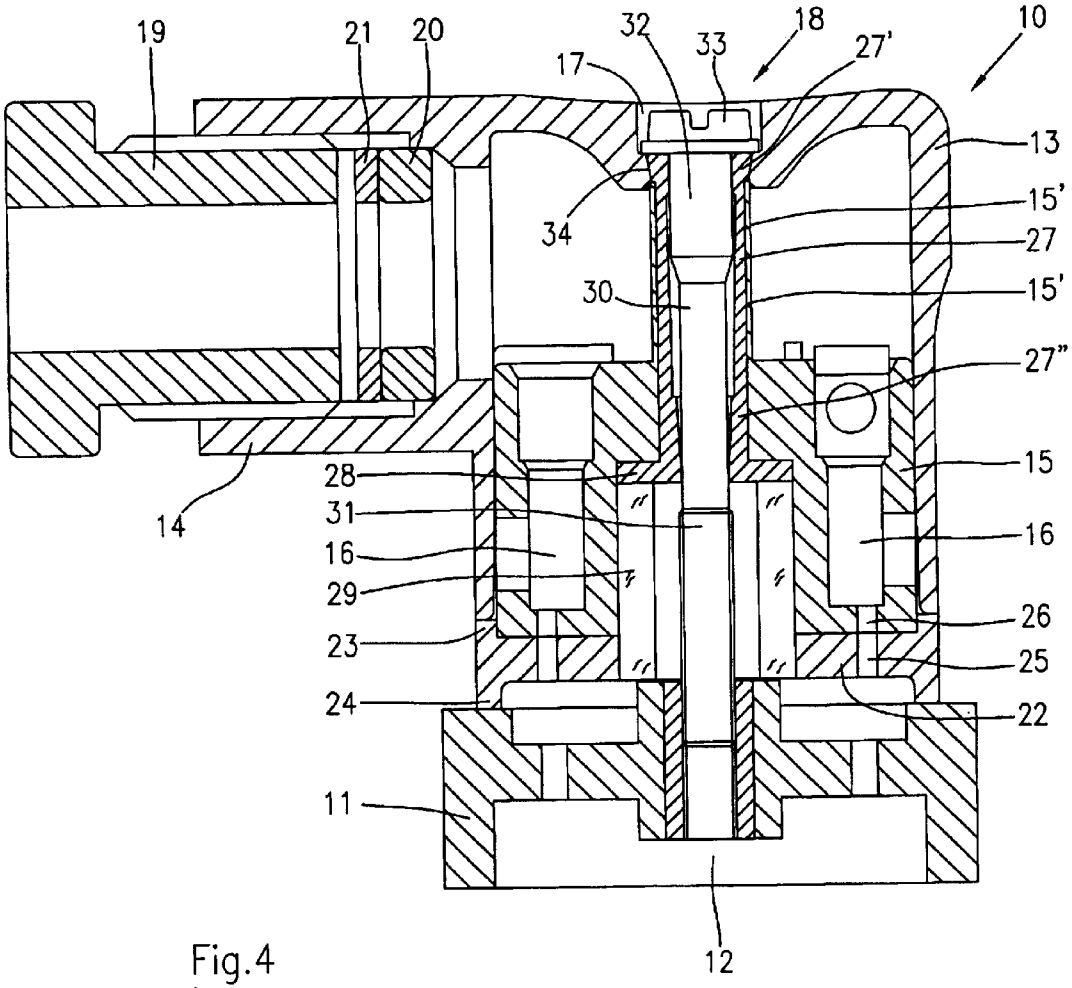
FIG. 4 shows a cross-sectional view again similar to that of the previous figures, to illustrate the final fastening step of the connector and the compression of the front gasket, upon final screwing of the anchoring screw.

FIGS. 2–4 of the accompanying drawings clearly show the steps for performing the watertight seals during the assembling and fastening of the connector to the junction block 11.

Initially, after having connected the wires of an electric cable to the contact elements of the connector 10 and after having disposed the contact support body 15 into the outer casing 13, the anchoring screw 18 is firstly passed through the tubular sealing element or guide sleeve 27.

As long as the neck portion 32 of larger diameter of the screw 18 does not come into contact with the shaped head 27' of the tubular sealing element 27, the shaped head 27' does not undergo any expansion or compression, allowing a free sliding of the screw 18.

As soon as the screw 18 is pushed forward, starting from the position of FIG. 1, firstly the cone-shaped portion 32', and then the cylindrical portion of larger diameter of the neck 32, radially expand the shaped head 27' of the tubular sealing element 27, urging it radially against the conical shoulder surface 34 of the hole 17; this condition is shown in FIG. 2 of the accompanying drawings.

Once the connector 10 has been assembled, and the anchoring screw 18 has been inserted completely into the connector, since the threaded portion 31 has a slightly larger diameter than the minimum inner diameter of the conical hole portion 27" of the tubular sealing element 27, there is no longer any risk of said screw 18 from accidentally slipping out.

At this point it is possible to electrically connect and mechanically secure the connector 10 to the contact junction block 11, simultaneously achieving the necessary watertight seals.

In this connection, as shown in FIG. 3, during a first tightening step of the screw 18, after the head 27' of the tubular sealing element has already been subjected to radial expansion by the neck 32 of the anchoring screw 18, by screwing the latter into the threaded hole 12 in the block 11, an annular shoulder surface 33' of the head 33 will cause a progressive axial compression of the shaped head 27' against the conical shoulder surface 34 of the hole 17. This condition is shown in the view in FIG. 3.

At this point, the seal forming steps between the screw 18 and the hole 17 will have been completed.

By continuing the tightening of the screw 18 into the threaded hole 12 in the block 11 exerting an appropriate driving torque, due to the axial traction which is exerted, by the same screw, the casing 13 of the connector will exert a strong axial compression of the gasket 22 along the peripheral edges 23 and 24; in this way, the gasket 22 is tightly gripped between the opposite edges of the wall of the casing 13 and of the junction block 11. This latter condition is shown in the cross-sectional view of FIG. 4.

At this point the connector 10 is electrically and mechanically connected to the junction block 11, ensuring all the necessary watertight seals, both in correspondence with the tubular extension 14 for passage of the electric cable due to the bush 19 and gasket 20, and in correspondence with the anchoring screw 18, and between opposite facing surfaces of the connector 10 and of the junction block 11.

From what has been shown in the accompanying drawings, it will be clear that what is provided is an electrical connector with a screw-type anchoring system, provided with an extremely valid and highly reliable watertight seal, especially in correspondence with the central anchoring screw and the front extremity for coupling with a contact supporting terminal strip, and of such kind as to permit the repeated removal and/or disassembly of the connector without jeopardizing the seals in any way whatsoever.

By co-molding the front gasket 22 and the tubular extension 27 of the body 15, for guiding and sealing the anchoring screw 18, directly onto the casing 13 for the contact support body 15, it is possible to obtain an extremely reliable and easily-assembled connector, which does not call for any complex manipulations by an operator.

In addition, the tubular sealing and guiding element 27 also provides a complete electrical insulation for the anchoring screw 18, with respect to the wires of the electric cable. Lastly, the shaped head 27' of the element 27, enables the contact support body 15 to be fitted into the casing 15, during assembling.

It is understood, however, that what has been described and shown with reference to the companying drawings, has been given purely by way of example in order to illustrate the general features of the connector according to the invention, and that other modifications may be made to the shape and structure of the entire connector, to the front gasket 22 and to the tubular element 27, without thereby departing from the scopes of the accompany claims.

What we claim is:

1. An electrical connector comprising:

an outer casing having a rear tubular extension for the passage of an electric cable;

a contact support body inside the casing, connectable to a contact junction block of an electric apparatus;

the connector is mechanically anchored to the junction block by screw means which can be screwed into a threaded hole of the junction block; and suitable watertight sealing means are provided between opposite front surfaces of the contact support body and the contact junction block, and in correspondence with the anchoring screw, wherein:

said sealing means comprise a flat shaped annular gasket of elastomeric material which extends between a front surface of the contact support body, a front edge of the casing and a peripheral surface of the contact junction block; and a tubular sealing element for the anchoring screw co-molded with the annular gasket, said tubular sealing element rearwardly extending from the contact support body, into a passing-through hole in the rear wall of the casing to be tightly urged against a shoulder surface of said hole by the insertion and tightening of the anchoring screw to said contact junction block.

2. Electrical connector according to claim 1, wherein the annular gasket at the front side of the connector is provided on both sides with a step-shaped peripheral rim coplanary arranged to a peripheral wall of the casing.

3. Electrical connector according to claim 1, wherein said tubular sealing element is extending inside a rigid support sleeve.

4. Electrical connector according to claim 3, wherein said support sleeve for the tubular sealing element, is integral with and rearwardly extending from the contact support body of the connector, towards said hole for the anchoring screw.

5. Electrical connector according to claim 1, wherein said anchoring screw is provided with surface means to radially expand and axially compress a shaped head of the tubular sealing element, against said shoulder annular surface of the passing-through hole.

6. Electrical connector according to claim 5, wherein said surface means for the compression of the shaped head of the tubular sealing element, comprise a cylindrical neck portion of the anchoring screw, having a diameter larger than the internal diameter of the shaped head of the tubular sealing element.

7. Electrical connector according to claim 5, wherein said surface means for the compression of the shaped head of the tubular sealing element, comprises said annular shoulder surface at the rear end of the anchoring screw.

8. Electrical connector according to claim 1, in which the anchoring screw is provided with a central shank portion having a first diameter, and a threaded fore portion having a second diameter larger than that of the central shank, wherein the tubular sealing element, in correspondence with the threaded portion of the screw, is provided with a conical hole having an internal diameter slightly smaller than the diameter of the threaded portion of the anchoring screw.

* * * * *